US008647089B2

(12) United States Patent
Simonds

(10) Patent No.: US 8,647,089 B2
(45) Date of Patent: Feb. 11, 2014

(54) DUAL ROTOR PUMP

(76) Inventor: Edward L. Simonds, Salem, OR (US)

( * ) Notice: Subject to any disclaimer, the term of this patent is extended or adjusted under 35 U.S.C. 154(b) by 0 days.

(21) Appl. No.: 13/543,322

(22) Filed: Jul. 6, 2012

(65) Prior Publication Data

US 2013/0011292 A1 Jan. 10, 2013

Related U.S. Application Data

(60) Provisional application No. 61/505,991, filed on Jul. 8, 2011.

(51) Int. Cl.

| | |
|---|---|
| ***F01C 1/08*** | (2006.01) |
| ***F03C 2/00*** | (2006.01) |
| ***F03C 4/00*** | (2006.01) |

(52) U.S. Cl.

USPC ..... 418/191; 418/9; 418/189; 418/206.1; 418/206.6

(58) Field of Classification Search

USPC ..... 418/9, 189–190, 191, 206.1–206.8

See application file for complete search history.

(56) References Cited

U.S. PATENT DOCUMENTS

| | | | | |
|---|---|---|---|---|
| 1,997,370 | A * | 4/1935 | Le Vesconte | 418/206.1 |
| 3,602,617 | A * | 8/1971 | Takahashi | 418/206.1 |
| 4,747,762 | A * | 5/1988 | Fairbairn | 418/191 |
| 5,518,382 | A * | 5/1996 | Gennaro | 418/206.5 |
| 6,935,851 | B2 * | 8/2005 | Peters et al. | 418/206.1 |
| 7,008,201 | B2 * | 3/2006 | Heizer | 418/201.1 |

* cited by examiner

*Primary Examiner* — Theresa Trieu

(74) *Attorney, Agent, or Firm* — Chernoff Vilhauer McClung & Stenzel, LLP

(57) ABSTRACT

A pump includes a pump body defining first and second cavities. First and second rotors are disposed in the first and second cavities between an inlet passage and an outlet passage and are in sealing relationship with each other during rotation of the rotors. A drive transmission mechanism is coupled to the first and second rotors for rotating the rotors in opposite directions. During a revolution of the first rotor, a vane projecting from the first rotor emerges from a recess of the second rotor, passes the inlet passage and the outlet passage, and enters a recess of the second rotor, while the inlet passage remains sealed from the outlet passage.

10 Claims, 3 Drawing Sheets

DUAL ROTOR PUMP

CROSS-REFERENCE TO RELATED APPLICATION

This application claims benefit of U.S. Provisional Application No. 61/505,991 filed Jul. 8, 2011, the entire disclosure of which is hereby incorporated herein by reference for all purposes.

BACKGROUND OF THE INVENTION

The subject matter of this application relates to a pump.

SUMMARY OF THE INVENTION

In accordance with a first aspect of the subject matter disclosed herein there is provided a pump comprising a pump body defining an interior space having a first cavity and a second cavity, the first cavity having a cylindrical bounding surface and the second cavity having a bounding surface that includes a cylindrical portion, and the pump body also defining an inlet chamber and an outlet chamber positioned at least partially between the first and second cavities, an input passage opening into the inlet chamber, and an output passage opening from the outlet chamber, a first rotor member supported in the first cavity for rotating about a first rotational axis that coincides substantially with a central axis of the cylindrical bounding surface of the first cavity, the first rotor member having a cylindrical external surface and n vanes (n greater than one) projecting radially therefrom in equiangularly spaced relationship about the first axis, the vanes having tips lying on a cylindrical surface that is substantially equal in diameter to the cylindrical bounding surface of the first cavity, whereby during rotation of the first rotor member the tips of the vanes pass in effective sealing relationship with the bounding surface region of the first cavity, and wherein the cylindrical bounding surface of the first cavity extends at least 360/n degrees about said first axis, and a second rotor member supported in the second cavity for rotating about a second rotational axis that is parallel with the first rotational axis and coincides substantially with a central axis of the two cylindrical portions of the bounding surface of the second cavity, the second rotor member having a cylindrical external surface substantially equal in diameter to the cylindrical portion of the bounding surface of the second cavity, whereby during rotation of the second rotor member the cylindrical external surface of the second rotor member is in effective sealing relationship with the cylindrical portion of the bounding surface of the second cavity, and wherein the cylindrical external surface of the second rotor has n recesses therein in equiangularly spaced relationship about the second axis, wherein the first and second rotor members are disposed between the inlet chamber and the outlet chamber and the first and second rotor members are in effective sealing relationship with each other during rotation of the rotor members, the cylindrical portion of the bounding surface of the second cavity subtends an angle at the second axis at least as great as the angle subtended at the second axis by each recess in the cylindrical external surface of the second rotor member, and the pump further comprises a drive transmission mechanism coupled to the first and second rotor members for rotating the rotor members in opposite directions at equal angular velocities so that during a complete revolution of the first rotor member each vane successively emerges from a recess of the second rotor member, passes the inlet passage and the outlet passage, and enters a recess of the second rotor member, while the inlet chamber remains effectively sealed from the outlet chamber.

In accordance with a second aspect of the subject matter disclosed herein there is provided a pump comprising a pump body defining an interior space having a first cavity and a second cavity, the first cavity having a cylindrical bounding surface and the second cavity having a bounding surface that includes a cylindrical portion, and the pump body also defining an inlet chamber and an outlet chamber positioned at least partially between the first and second cavities, an input passage opening into the inlet chamber, and an output passage opening from the outlet chamber, a first rotor member supported in the first cavity for rotating about a first rotational axis that coincides substantially with a central axis of the cylindrical bounding surface of the first cavity, the first rotor member having a cylindrical external surface and n vanes (n greater than one) projecting radially therefrom in equiangularly spaced relationship about the first axis, the vanes having tips lying on a cylindrical surface that is substantially equal in diameter to the cylindrical bounding surface of the first cavity, whereby during rotation of the first rotor member the tips of the vanes pass in effective sealing relationship with the bounding surface region of the first cavity, and wherein the cylindrical bounding surface of the first cavity extends at least 360/n degrees about said first axis, and a second rotor member supported in the second cavity for rotating about a second rotational axis that is parallel with the first rotational axis and coincides substantially with a central axis of the two cylindrical portions of the bounding surface of the second cavity, the second rotor member having a cylindrical external surface substantially equal in diameter to the cylindrical portion of the bounding surface of the second cavity, whereby during rotation of the second rotor member the cylindrical external surface of the second rotor member is in effective sealing relationship with the cylindrical portion of the bounding surface of the second cavity, and wherein the cylindrical external surface of the second rotor has at least one recess therein, wherein the first and second rotor members are disposed between the inlet chamber and the outlet chamber and the first and second rotor members are in effective sealing relationship with each other during rotation of the rotor members, the cylindrical portion of the bounding surface of the second cavity subtends an angle at the second axis at least as great as the angle subtended at the second axis by said recess in the cylindrical external surface of the second rotor member, and the pump further comprises a drive transmission mechanism coupled to the first and second rotor members for rotating the rotor members in opposite directions at angular velocities such that during a complete revolution of the first rotor member each vane successively emerges from a recess of the second rotor member, passes the inlet passage and the outlet passage, and enters a recess of the second rotor member, while the inlet chamber remains effectively sealed from the outlet chamber.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
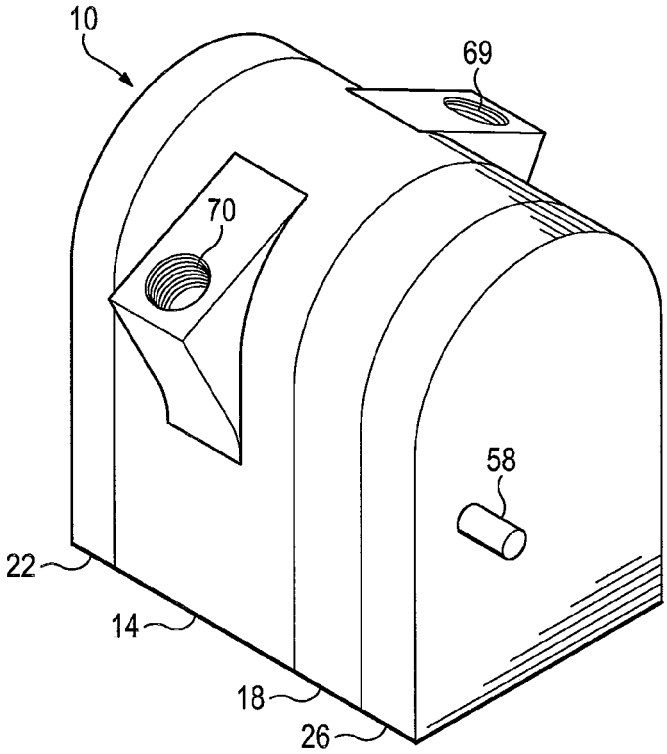
FIG. 1 is a perspective view of a pump.
Figure 2:
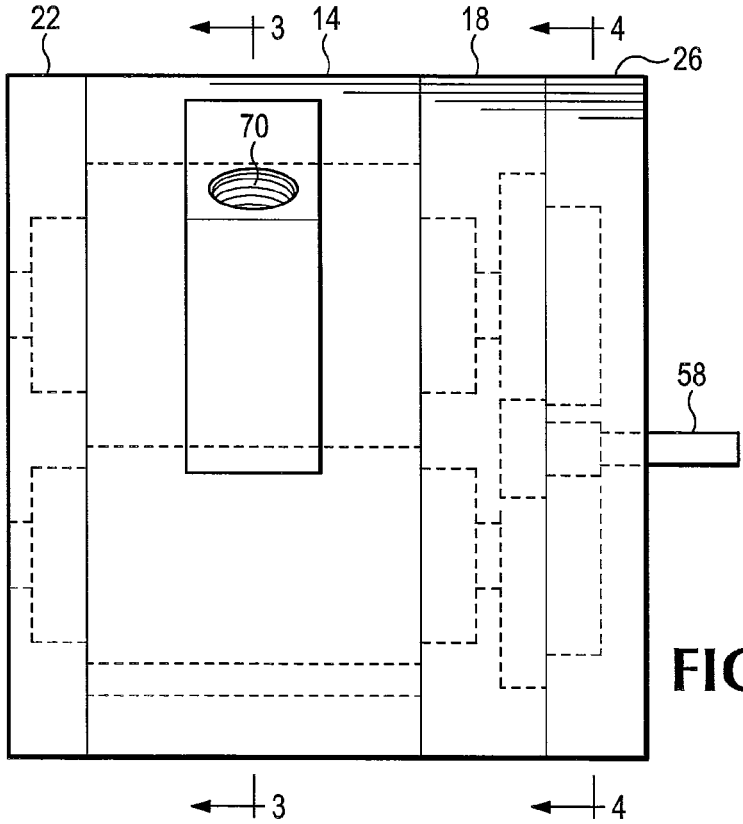
FIG. 2 is a side elevation of a pump.
Figure 3:
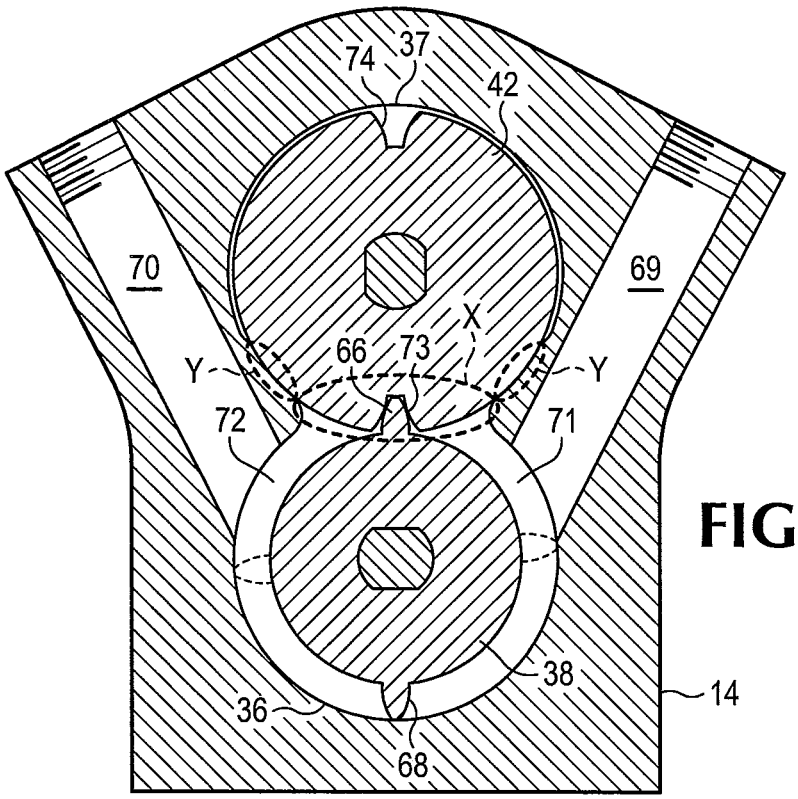
FIG. 3 is a sectional view of the pump taken on the line 3-3 in FIG. 2.
Figure 5:
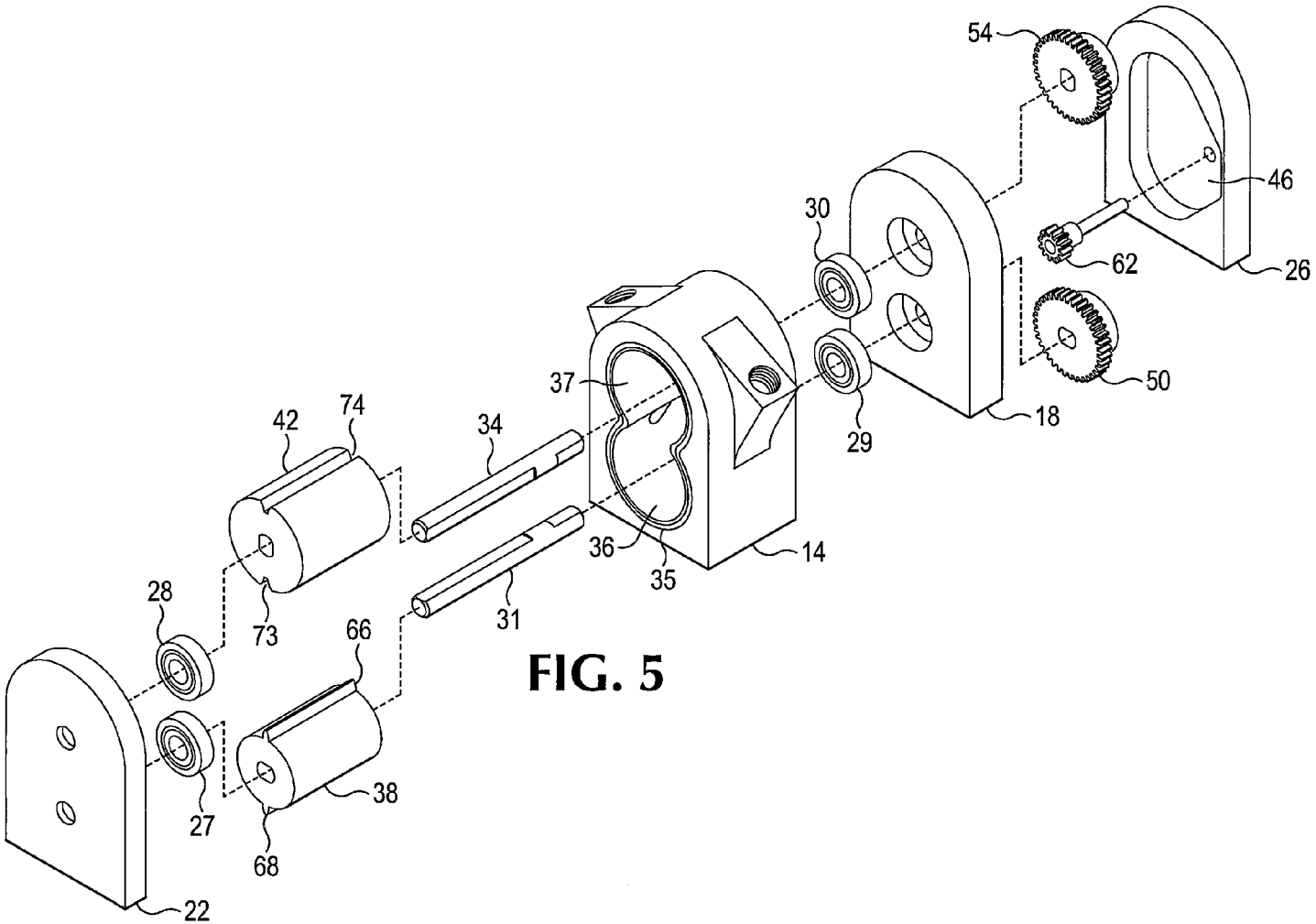
FIG. 5 is an exploded perspective view of the pump.

Referring to FIGS. 2 and 3, the illustrated pump comprises a pump body 10 composed of a pump rotor housing 14, a gear housing 18 and two end caps 22, 26. The end cap 22 is formed with two recesses that accommodate respective ball bearings 27, 28 and the gear housing 18 is similarly formed with two recesses that accommodate respective ball bearings 29, 30. The outer races of the ball bearings are press fitted in the respective recesses. First and second rotor drive shafts 31, 34 are press fitted in the inner races of the bearings and extend parallel to one another through the interior space of the pump rotor housing 14. The interior space of the pump rotor housing is composed of two generally cylindrical cavities 36, 37 that intersect in a region X (FIG. 3). Two seals (only one of which, designated 35, is shown in FIG. 5) surround the periphery of the interior space and are in sealing engagement with the end cap 22 and the gear housing 18 respectively. A work rotor 38 and a sealing rotor 42 are mounted on the shafts 30, 34 respectively and are keyed for rotation with the shafts. The rotors are located in the cavities 36, 37 respectively.

Figure 4:
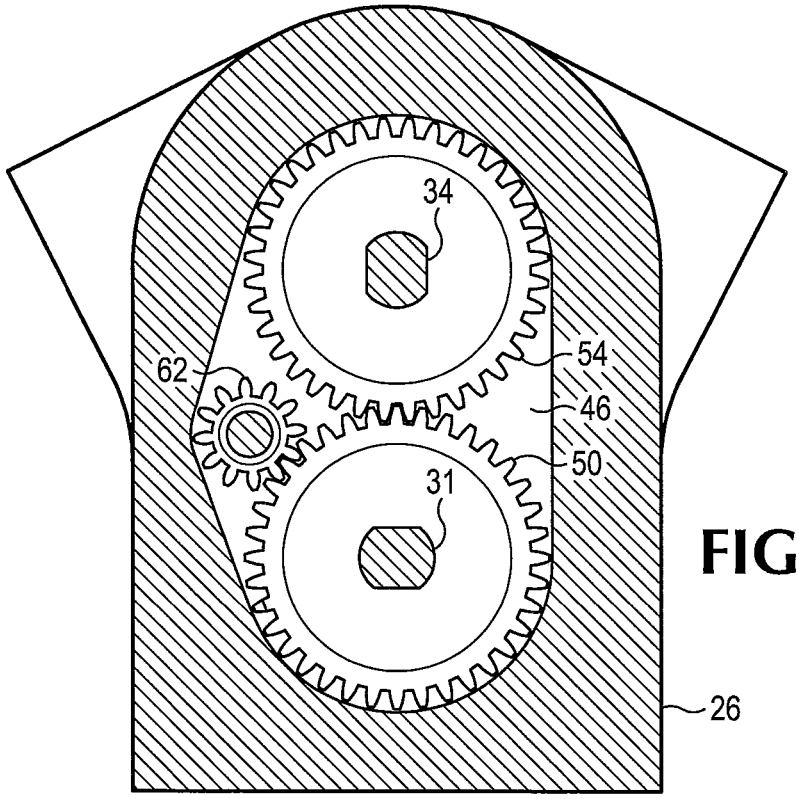
FIG. 4 is a sectional view of the pump taken on the line 4-4 in FIG. 2.

The gear housing 18 is formed on the opposite side from the bearing recesses with a gear recess 46 (FIG. 4) into which the two shafts 31, 34 extend. Two spur gears 50, 54 of equal size are fitted on the shafts 31, 34 respectively and are located in the gear recess 46. The two spur gears are in meshing engagement. Each gear includes a cylindrical boss that projects into a recess 46 in the end cap 26.

An electric motor (not shown) having a drive shaft 58 is attached to the end cap 26. A drive pinion 62 is attached to the drive shaft of the motor and is in meshing engagement with the spur gear 50. Accordingly, when the motor drives the pinion 62, the two spur gears 50, 54 are driven at equal speeds in opposite directions.

The work rotor 38 is generally cylindrical and has two diametrically opposed vanes 66, 68 extending parallel to the central axis of the work rotor and projecting radially therefrom. When the work rotor rotates within the cavity 36 of the interior space, a small clearance exists between the tip of the vanes and the surface bounding the cavity 36. Thus, as the work rotor rotates, the work rotor and the pump rotor housing are in an effective sealing relationship. The cylindrical surface of the lower cavity extends at least 180 degrees about the central axis of the work rotor so that there is always at least one vane between the inlet passage and the outlet passage.

The pump rotor housing 14 is formed with an inlet passage 69 and an outlet passage 70 that communicate with the cavity 36. The upper end of each passage is internally threaded to receive a suitable hose attachment fitting.

The sealing rotor 42 is generally cylindrical and is formed with two peripheral notches 73, 74 that extend longitudinally of the rotor parallel to the axis of rotation of the rotor.

It will be appreciated from examination of FIG. 3 that the configuration of the work rotor 38 corresponds to a spur gear in which all the teeth but two have been removed and the configuration of the sealing rotor 42 corresponds to a spur gear in which all the spaces but two between the teeth have been filled.

The radius of curvature of the upper cavity 37 in the regions Y is slightly greater than the radius of the cylindrical surface of the sealing rotor. The peripheral surface of the upper cavity in each of the regions Y subtends an angle at least as great as the angle subtended by the peripheral notches 73, 74, so that during rotation of the sealing rotor the external surface of the sealing rotor remains in effective sealing relationship with the pump rotor housing with respect to flow of gas around the sealing rotor.

The radius of curvature of the cavity 37 between the regions Y is somewhat greater than in the regions Y, which facilitates manufacture of the pump rotor housing because the tolerance on the dimensions of the peripheral surface of the upper cavity between the regions Y may then be greater than in the regions Y.

As shown in FIG. 3, the vane 66 of the work rotor is positioned in the notch 73 of the sealing rotor. This position is referred to as the 12 o'clock position, having regard to the angular position of the vane 66. As the work rotor rotates in the clockwise direction (and the sealing rotor rotates in the counter clockwise direction), the trailing flank of the vane 66 rolls over the flank of the notch 73 and ultimately disengages from the notch. As the rotors continue to rotate, a very narrow clearance is defined between the cylindrical surface of the work rotor and the cylindrical surface of the sealing rotor. When the work rotor has rotated through almost 180°, the vane 68 rolls into the notch 74 and the cooperation between the surface of the vane and the surface of the notch maintains a narrow clearance between the work rotor and the sealing rotor. At all angular positions of the work rotor 38, there is a very narrow clearance between the work rotor and the sealing rotor 42. The narrow clearance provides an effective sealing relationship between the work rotor and the sealing rotor. The seal between the work rotor and the sealing rotor is referred to herein as the rotor seal. The notches in the sealing rotor accommodate the vanes when the work rotor rotates without destroying the rotor seal.

Depending on the angular position of the work rotor 38, the sealing rotor 42 and the two vanes 66, 68 define two or three chambers within the cavity 36. At the position shown in FIG. 3, there is an inlet chamber 71 and an outlet chamber 72. The inlet passage 69 opens into the inlet chamber 71 and the outlet passage 70 opens from the outlet chamber 72.

Referring again to FIG. 3, as the work rotor rotates from the 12 o'clock position to about 2 o'clock, the vane 66 reaches and passes the upper edge of the inlet passage. The inlet chamber 71 is defined between the vane 68 and the rotor seal. Thus, as the rotor rotates the volume of the inlet chamber 71 increases and tends to cause a reduction in pressure in the inlet chamber thereby inducing a flow of gas into the inlet chamber from the inlet passage 69.

When the vane 66 reaches the lower edge of the inlet passage, the inlet chamber 71 that was bounded by the trailing flank of the vane 68 becomes a transfer chamber and a new inlet chamber 73 is created between the rotor seal and the trailing flank of the vane 66. The transfer chamber 71 between the leading flank of the vane 66 and the trailing flank of the vane 68 is isolated from the inlet passage. A quantity of gas is trapped in the transfer chamber, except for minor leakage between the tips of the vanes and the peripheral surface of the lower cavity 36. Advancing movement of the vane 66 pushes the trapped gas in the clockwise direction about the central axis of the working rotor.

As the work rotor continues to rotate, the tip of the vane 68 reaches the lower edge of the outlet passage 70. The outlet chamber and the transfer chamber are then in communication and a new outlet chamber is thereby created between the leading flank of the vane 66 and the rotor seal. The work rotor continues to rotate and the advancing of the vane 66 decreases the volume of the outlet chamber, tending to increase the pressure in the outlet chamber and expel gas from the outlet chamber through the outlet passage 40. The rotor seal and the narrow clearance between the peripheral surface of the upper cavity in the region Y and the cylindrical surface of the sealing rotor in the region Y provides a large resistance to leakage of gas from the outlet chamber. Accordingly, most gas is forced to leave the outlet chamber through the outlet passage.

The term effective sealing relationship used herein does not require a perfect seal, with the external surfaces of the work rotor and the sealing rotor, for example, continuously in sealing contact. An effective sealing relationship between two members requires that the rate at which fluid can leak between the members should be small relative to the rate at which fluid is delivered from the inlet passage to the outlet passage.

In a conventional external gear pump, the gear teeth divide the incoming flow of air into two streams, each of which is chopped by gear teeth into small volumes which are subsequently combined. This manner of operation consumes energy, resulting in heating of the gas. In the case of the pump illustrated in FIG. 1-5, all the gas proceeds from the inlet passage to the outlet passage along the same path and for each revolution of the work rotor, the flow of gas is chopped into only two volumes.

In a modification of the pump shown in FIGS. 1-5, the external surfaces of the rotors and internal surfaces of the cavities are in contact, thereby improving the rotor seal and the seals between the rotors and the pump rotor housing. In order to minimize friction between surfaces, which would result in heating of the pump components and possible bear of the pump components, the surfaces may be provided with anti-friction coatings.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. For example, the invention is not restricted to the sealing rotor having the same number of notches as the number of vanes of the work rotor. With suitable adjustments in timing of rotation of the rotors, the sealing rotor may have only one notch. Moreover, the work rotor may have more than two vanes, although it will be appreciated that as the number of vanes increases, the volume of the pump available for pumping fluid will decrease. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A pump comprising:

a pump body defining an interior space having a first cavity and a second cavity, and the pump body also defining an inlet chamber and an outlet chamber, an input passage opening into the inlet chamber, and an output passage opening from the outlet chamber, a first rotor rotatably supported in the first cavity and for rotating about a first axis, the first rotor having n vanes (n greater than one) projecting radially therefrom in equiangularly spaced relationship about the first rotor, the vanes having tips whereby during rotation of the first rotor the tips of the vanes pass in effective sealing relationship with a bounding surface of the first cavity that extends at least 360/n degrees about said first axis, a second rotor rotatably supported in the second cavity, whereby during rotation of the second rotor, the second rotor is in effective sealing relationship with at least a portion of the bounding surface of the second cavity, and wherein the second rotor defines n recesses therein in equiangularly spaced relationship about the second rotor, wherein the first and second rotors are disposed between the inlet chamber and the outlet chamber and the first and second rotors are in effective sealing relationship with each other during rotation of the rotors, a drive transmission mechanism coupled to the first and second rotors for rotating the rotors in opposite directions at equal angular velocities so that during a complete revolution of the first rotor each vane successively emerges from a recess of the second rotor, passes the inlet passage and the outlet passage, and enters a recess of the second rotor, while the inlet chamber remains effectively sealed from the outlet chamber, where each of said recesses is effectively sealed from said inlet chamber and said outlet chamber for all of said complete revolution.

2. A pump according to claim 1, wherein n is equal to two.

3. A pump according to claim 1, wherein the first rotor is cylindrical and has a first radius extending to the tip of a vane, and the second rotor is cylindrical and has a second radius to its outermost surface, where said first radius is substantially equal to said second radius.

4. A pump according to claim 1, wherein the first rotor is mounted on a first shaft that is journalled for rotation relative to the pump body, the second rotor is mounted on a second shaft that is journalled for rotation relative to the pump body, and the drive transmission mechanism comprises first and second spur gears mounted on the first and second shafts respectively and in meshing engagement with each other.

5. A pump according to claim 1, wherein the bounding surface of the second cavity includes an inlet side cylindrical portion and an outlet side cylindrical portion, the inlet side cylindrical portion has a free edge, the outlet side cylindrical portion has a free edge, and said inlet side cylindrical portion and said outlet side cylindrical portion each subtend an angle at least as great as the angle subtended by each recess in the cylindrical external surface of the second rotor.

6. A pump according to claim 1, wherein the tips of the vanes clear the bounding surface of the first cavity.

7. A pump according to claim 1, wherein during rotation of the first and second rotors, external surfaces of the first and second rotors clear each other.

8. A pump according to claim 1, wherein said second cavity defines a generally cylindrical bounding surface having a first portion with a first radius of curvature around a longitudinal axis of said second cavity and a second portion with a second radius of curvature around said longitudinal axis, where said second radius of curvature is less than said first radius of curvature.

9. A pump according to claim 8 where each of said n recesses subtends a first angle around said longitudinal axis, and said second portion subtends a second angle around said longitudinal axis at least as large as said first angle.

10. A pump comprising:

a pump body defining an interior space having a first cavity and a second cavity, said second cavity defining a generally cylindrical bounding surface having a first portion with a first radius of curvature from a longitudinal axis of said first cavity and a second portion with a second radius of curvature from said longitudinal axis, where said second radius of curvature is less than said first radius of curvature, and the pump body also defining an inlet chamber and an outlet chamber, an input passage opening into the inlet chamber, and an output passage opening from the outlet chamber, a first rotor rotatably supported in the first cavity, the first rotor having n vanes (n greater than one) projecting radially therefrom in equiangularly spaced relationship about the first rotor, the vanes having tips whereby during rotation of the first rotor the tips of the vanes pass in effective sealing relationship with a bounding surface of the first cavity that extends at least 360/n degrees about a rotational axis of said first rotor, a second rotor rotatably supported in the second cavity, whereby during rotation of the second rotor, the second rotor is in effective sealing relationship with at least a portion of the bounding surface of the second cavity, and wherein the second rotor defines n recesses therein in equiangularly spaced relationship about the second rotor, wherein the first and second rotors are disposed between the inlet chamber and the outlet chamber and the first and second rotors are in effective sealing relationship with each other during rotation of the rotors, and a drive transmission mechanism coupled to the first and second rotors for rotating the rotors in opposite directions at equal angular velocities so that during a complete revolution of the first rotor each vane successively emerges from a recess of the second rotor, passes the inlet passage and the outlet passage, and enters a recess of the second rotor, while the inlet chamber remains effectively sealed from the outlet chamber, where each of said n recesses subtends a first angle around said longitudinal axis, and second portion subtends a second angle around said longitudinal axis at least as large as said first angle.

* * * * *